US011387614B1

(12) United States Patent
Feld

(10) Patent No.: US 11,387,614 B1
(45) **Date of Patent: *Jul. 12, 2022**

(54) ELECTRICAL PLUG

(71) Applicant: Jack Enterprises LLC, Aberdeen, ID (US)

(72) Inventor: Kylan Feld, Aberdeen, ID (US)

(73) Assignee: Jack Enterprises LLC, Aberdeen, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/214,503

(22) Filed: Mar. 26, 2021

Related U.S. Application Data

(63) Continuation-in-part of application No. 16/183,425, filed on Nov. 7, 2018, now Pat. No. 10,992,091.

(60) Provisional application No. 62/590,777, filed on Nov. 27, 2017.

(51) Int. Cl.

| | |
|---|---|
| ***H01R 13/58*** | (2006.01) |
| ***H01R 27/00*** | (2006.01) |
| ***H01R 13/512*** | (2006.01) |
| ***H01R 13/42*** | (2006.01) |

(52) U.S. Cl.
CPC ..... *H01R 27/00* (2013.01); *H01R 13/42* (2013.01); *H01R 13/512* (2013.01)

(58) Field of Classification Search
CPC .. H01R 13/58; H01R 13/595; H01R 13/5812; H01R 103/00; H01R 35/02
See application file for complete search history.

(56) References Cited

U.S. PATENT DOCUMENTS 2,419,018 A * 4/1947 Gudie ..... H01R 13/426 174/21 JS
3,588,783 A * 6/1971 Newman ..... H01R 13/5025 439/598
4,284,317 A * 8/1981 Doyle ..... H01R 13/567 439/694

(Continued)

OTHER PUBLICATIONS

Legrand, "Pass & Seymour® Turnlok® Extra-Hard Use Plugs & Connectors" technical specification sheet, Jan. 2016. Retrieved from the internet <URL: http://www.farnell.com/datasheets/2358728.pdf>.

(Continued)

*Primary Examiner* — Phuong Chi Thi Nguyen
(74) *Attorney, Agent, or Firm* — Hawley Troxell Ennis & Hawley LLP; Rivkah Young

(57) ABSTRACT

An electrical plug accommodates many different angular configurations of electrical contacts, has a modular design, and is sturdy and robust. In one embodiment, a reconfigurable power cord assembly includes an electrical plug having a plug body having a plurality of cavities, each cavity for receiving a single electrical contact, at least one cavity configured to allow the respective electrical contact to be positioned in one of the plurality of cavities, at one of a plurality of angular positions, each electrical contact being supported within its cavity by a contact retainer that mounts within the plug body to secure respective electrical contacts within the plug body in a predetermined orientation, wherein the plug body is configured to accommodate a plurality of electrical contact orientations, the contact retainer being removably and rotatably attached to the interior of the plug body.

20 Claims, 12 Drawing Sheets

(56) References Cited

U.S. PATENT DOCUMENTS

| | | | | |
|---|---|---|---|---|
| 4,407,553 | A | 10/1983 | Dvorachek et al. | |
| 6,065,997 | A * | 5/2000 | Wang | H01R 24/542 439/578 |
| 8,262,403 | B2 | 9/2012 | Slippy et al. | |
| 8,864,514 | B2 | 10/2014 | Ilyes | |
| 9,450,347 | B2 | 9/2016 | Kondou et al. | |

OTHER PUBLICATIONS

Hubbell "Twist-Lock® Devices 30A, 125/250V AC, 3 Pole, 4 Wire Grounding Insulgrip® Plug," technical specification sheet. [retrieved on Mar. 22, 2021]. Retrieved from the internet <URL: https://hubbellcdn.com/specsheet/WIRING_HBL2711_spec.pdf>.

* cited by examiner

ELECTRICAL PLUG

RELATED APPLICATIONS

This application is a continuation-in-part of Feld, U.S. patent application Ser. No. 16/183,425, filed Nov. 7, 2018, entitled "ELECTRICAL PLUG," which claims priority to Feld, U.S. Provisional Patent Application No. 62/590,777, filed on Nov. 27, 2017, entitled "ELECTRICAL PLUG," which is herein incorporated by reference in its entirety as if it were fully set forth herein.

BACKGROUND

Electrical plugs come in a wide variety of sizes and shapes, depending on the current and voltage characteristics they are designed for, and the mating surface they mate with, such as with a male plug designed to mate with a female socket, and so forth.

In some circumstances, such as in a household having a washer and a dryer, individual electrical power cords are respectively attached to each device and then are plugged into individual power receptacles, also called sockets, established at the surface of a wall, after which power is supplied through the receptacles, through the power cords, to the respective devices.

Typically, the power cables that are utilized to power a given device are removably attached to the given device, and each power cable assembly is typically molded with a fixed number of electrical contacts through which the power is supplied, and also is molded with those electrical contacts fixed in a given angular and positional orientation.

A drawback to current power systems that supply power through a power cable that is removably attached to a device is that each power cable must typically be provided in various individual and separate configurations, varying the number of electrical contacts, and therefore the number of power cable conductors, and also varying the number of angular orientations of those contacts. For two different numbers of conductors, e.g. a cable having three conductors and a cable having four conductors, and for two different angular orientations of a single electrical contact of the electrical plug, e.g. horizontally with respect to some reference or vertically with respect to the same reference, up to six different plug configurations, and therefore, up to six separate components/sku numbers would be required.

What is therefore needed is an electrical plug having reconfigurable electrical contacts.

SUMMARY

A reconfigurable power cord assembly includes a power cord having two or more conductors, where each individual conductor has a respective electrical contact conductively attached thereto. In one embodiment, attachment of an electrical contact to a conductor of a power cord is achieved with a crimped connection. In one embodiment, attachment of an electrical contact to a conductor of a power cord is achieved with a soldered connection. In one embodiment, attachment of an electrical contact to a conductor of a power cord is achieved with a screw-type or other type clamped connection.

In one embodiment, a reconfigurable power cord assembly includes power plug having a plug body including a plurality of cavities, each cavity for receiving a single electrical contact and including a contact slot for passing a portion of the electrical contact from the interior of the electrical plug to the exterior of the electrical plug, thus enabling exterior portions of the electrical contacts to make contact with electrical contacts of a mating socket or plug.

In one embodiment, the electrical contacts of the electrical plug are male, and thus extend from the body of the electrical plug. In one embodiment, the electrical contacts of the electrical plug are female, and thus form a socket within which male contacts from an interfacing entity will be inserted into the female contacts of the electrical plug.

In one embodiment, each electrical contact is supported within its cavity by a respective contact retainer that mounts within the plug body to secure the respective electrical contacts within the plug body in a predetermined angular orientation, wherein the plug body is configured to accommodate a plurality of angular electrical contact orientations, the contact retainer being removably and rotateably attached to the interior of the plug body.

In one embodiment the plug body of the reconfigurable power cord is configured to accommodate a fixed maximum number of electrical contacts in a plurality of electrical contact orientations. In one embodiment, the plug body of the reconfigurable power cord is configured to accommodate up to four electrical contacts in up to seven different contact locations, e.g. cavities, with each electrical contact being able to rotate from a starting angular position to a desired alternative angular position during times when the electrical plug isn't fully assembled and is therefore at least partially disassembled or partially assembled. In one embodiment, the number of electrical contacts and the number of contact locations are equal. Thus, in one embodiment, an electrical plug includes two, three or four electrical contacts, with a respective two, three or four contact locations. In one embodiment, a given contact location is configured to allow installation of or replacement of a first electrical contact having a first shape, such as a flat shape, with a second electrical contact having a second shape, such as an arcuate shape, L shape, or a U shape.

In one embodiment, at least one electrical contact, when viewed end-on at a distal end of the electrical contact, is configured to be rotated during a configuration change process from a first angular position to a second angular position in order to accommodate a new angular configuration.

In one embodiment, an electrical contact when viewed end-on at a distal end of the electrical contact is configured to be rotated during a configuration change process up to 90 degrees along its longest axis from a first angular position to a second angular position in order to accommodate a new configuration.

In one embodiment, the electrical plug is configured so that when the electrical contact rotates during a configuration change, the respective contact retainer rotates a same number of degrees in the same direction as a degree of rotation of the electrical contact. In one embodiment, once an electrical contact is mated with a contact retainer, the assembly is considered to be permanent, such that the electrical contact may not later be removed from the contact retainer.

In one embodiment, the electrical plug includes at least one electrical contact when viewed end-on at a distal end of the electrical contact is configured to be rotated during a configuration change process a fixed number of degrees from a first angular configuration position to a second configuration position in order to accommodate a new angular configuration.

In one embodiment, at least one electrical contact when viewed end-on at a distal end of the electrical contact with respect to the plug body is configured to be rotated during a configuration change process up to 22.5 degrees from a first angular configuration position to a second angular configuration position in order to accommodate a new angular configuration.

In one embodiment, at least one electrical contact when viewed end-on at a distal end of the electrical contact with respect to the plug body is configured to be rotated during a configuration change process up to 45 degrees from a first angular configuration position to a second angular configuration position in order to accommodate a new angular configuration.

In one embodiment, at least one electrical contact when viewed end-on at a distal end of the electrical contact with respect to the plug body is configured to be rotated during a configuration change process up to 90 degrees from a first angular configuration position to a second angular configuration position in order to accommodate a new angular configuration.

In one embodiment, the plug body of the electrical plug is configured to accommodate different numbers of replaceable, configurable electrical contacts. In various embodiments, the plug body of the electrical plug is configured to accommodate a maximum of 2, 3, or 4 electrical contacts used for power.

In one embodiment, in a given configuration of the electrical plug, each electrical contact of the given configuration is secured within a contact retainer which itself is, when the electrical plug is in a fully assembled configuration, removably secured within a cavity of the plug body. In one embodiment, the contact retainer is thereby prevented from rotation within the cavity with respect to the body of the electrical plug when the contact retainer is in an operational position of the fully assembled configuration.

In one embodiment, the plug body includes a first body piece and a second body piece wherein when the electrical plug is fully assembled into a given configuration, the assembled plug body secures the contact retainers to prevent rotation of the contact retainers and therefore also the electrical contacts with respect to the plug body.

In one embodiment, the plug body includes a first body piece and a second body piece wherein when the electrical plug is fully assembled into a given configuration, the second body piece secures the contact retainers within the first body piece to prevent rotational movement of the contact retainers and the electrical contacts with respect to the plug body.

In one embodiment, the second body piece couples with the first body piece through threads on the exterior of the second body piece interfacing with thread channels on the interior of the first body piece. In one embodiment, the first body piece couples with the second body piece through threads on the exterior of the first body piece interfacing with thread channels on the interior of the second body piece.

In one embodiment, a configurable electrical plug assembly comprises a power cord having a plurality of conductors, each individual conductor having a respective electrical contact conductively attached thereto, a plug body, a first body piece, and one or more faceplates.

In one embodiment, the first body piece has a plurality of cavities, each cavity for receiving a single electrical contact, wherein at least one cavity is configured to allow the respective electrical contact to be positioned at one of a plurality of distinct angular positions. In one embodiment, each electrical contact is supported within its cavity by a contact retainer that mounts within the first body piece to secure respective electrical contacts within the first body piece in a predetermined orientation, the respective contact retainers being removably and rotatably attached to the interior of the first body piece. In one embodiment, a first faceplate couples with the first body piece, the first faceplate having one or more apertures configured to allow one or more of the electrical contacts to be locked in a first configuration at their respective predetermined cavities and angular orientations.

In one embodiment, the first body piece and the first faceplate are configured such that the first faceplate can be decoupled from the first body piece to allow at least one electrical contact to be re-positioned, wherein re-positioning the at least one electrical contact includes one or more of moving the at least one electrical contact from a first distinct angular position in a first distinct cavity to a second distinct angular position in the first distinct cavity, moving the at least one electrical contact from a first distinct angular position in a first distinct cavity to the first distinct angular position in a second distinct cavity, and moving the at least one electrical contact from a first distinct angular position in a first distinct cavity to a second distinct angular position in a second distinct cavity In one embodiment when a second faceplate is coupled with the first body piece, the second faceplate is utilized to lock the plurality of electrical contacts into a second configuration, the second configuration being distinct from the first configuration.

In one embodiment, the first body piece and the first faceplate are configured such that the first faceplate can be decoupled from the first body piece to allow at least one electrical contact, when viewed end-on at a distal end of the electrical contact, to be re-positioned within one of the plurality of cavities from a first distinct angular position to a second distinct angular position. In one embodiment, when a second faceplate is coupled with the first body piece, the second faceplate is utilized to lock the plurality of electrical contacts into a second configuration, the second configuration being distinct from the first configuration.

In one embodiment, the first body piece and the first faceplate are configured such that the first faceplate can be decoupled from the first body piece to allow at least one electrical contact, when viewed end-on at a distal end of the electrical contact, to be re-positioned within one of the plurality of cavities up to 90 degrees along its longest axis from a first distinct angular position to a second distinct angular position. In one embodiment, when a second faceplate is coupled with the first body piece, the second faceplate is utilized to lock the plurality of electrical contacts into a second configuration, the second configuration being distinct from the first configuration.

In one embodiment, the first body piece and the first faceplate are configured such that the first faceplate can be decoupled from the first body piece to allow at least one electrical contact, when viewed end-on at a distal end of the electrical contact, to be re-positioned within one of the plurality of cavities 90 degrees along its longest axis from a first distinct angular position to a second distinct angular position. In one embodiment, when a second faceplate is coupled with the first body piece, the second faceplate is utilized to lock the plurality of electrical contacts into a second configuration, the second configuration being distinct from the first configuration.

In one embodiment, the first body piece and the first faceplate are configured such that the first faceplate can be decoupled from the first body piece to allow at least one electrical contact, when viewed end-on at a distal end of the electrical contact with respect to the plug body, to be re-positioned within one of the plurality of cavities at least 45 degrees along its longest axis from a first distinct angular position to a second distinct angular position. In one embodiment, when a second faceplate is coupled with the first body piece, the second faceplate is utilized to lock the plurality of electrical contacts into a second configuration, the second configuration being distinct from the first configuration.

In one embodiment, the first body piece is configured so that when the electrical contact is re-positioned within one of the plurality of cavities, the respective contact retainer rotates a same number of degrees in the same direction as a degree of rotation of the electrical contact. In one embodiment, the first body piece, the first faceplate, and the second faceplate are configured to allow a fixed number of electrical contacts to be positioned within one of a number of cavities at one of a plurality of distinct angular positions. In one embodiment, the first faceplate that locks the contacts in the first configuration has apertures that are differently shaped, differently sized, and/or differently positioned than the apertures of the second faceplate that locks the contacts in the second configuration.

In one embodiment, when the electrical plug is fully assembled into a given configuration, a faceplate secures the contacts to prevent movement of the contact retainers and the electrical contacts with respect to the plug body. In one embodiment, in a given configuration, each electrical contact of the given configuration is secured within a contact retainer which itself is removably secured within a cavity of the first body piece, the contact retainer being prevented from rotation within the cavity when the contact retainer is locked in an operational position.

In one embodiment, a method for assembling and reconfiguring a reconfigurable power cord includes conductively attaching two or more electrical contacts to respective individual conductors of a power cable.

In one embodiment, the method proceeds with inserting of each of the two or more electrical contacts into respective contact retainers, forming respective contact combinations, e.g. an electrical contact and a contact retainer pair. In one embodiment, inserting an electrical contact into a contact retainer forms a permanent assembly that is designed not to be disassembled. In this disclosure, an assembly formed from an electrical contact and a contact retainer is referred to as a contact combination.

In one embodiment, the method proceeds with, for each contact combination, inserting each respective contact combination within the plug body so that the respective electrical contact is positioned within a predetermined cavity of the electrical plug and aligned at respective first predetermined angle for that particular electrical contact. Once each contact combination has been positioned within the plug body, the electrical plug body is assembled to lock the contact combinations into place within the plug body at the predetermined angles. At this point, electrical contacts are extruding from one end of the electrical plug and a power cable is exiting the other end of the electrical plug.

In one embodiment, the method for assembling and reconfiguring a reconfigurable power cord includes wherein one or more contact combinations are at a first predetermined angle with respect to a reference line and one or more contact combinations are at a second predetermined angle with respect to the reference line.

In one embodiment, the method for assembling and reconfiguring a reconfigurable power cord includes wherein one or more contact combinations are at a first predetermined angle with respect to a predetermined other contact combination and one or more contact combinations are at a second predetermined angle with respect to the predetermined other contact combination.

In one embodiment, the method for assembling and reconfiguring a reconfigurable power cord includes wherein the plug body comprises at least a first body piece having one or more body cavities for receiving contact combinations and a second body piece that, when the reconfigurable power cord is fully assembled, prevents contact combinations from pulling out of their respective body cavities.

In one embodiment, the method for assembling and reconfiguring a reconfigurable power cord further includes wherein the first body piece couples with the second body piece through threads on the exterior of the first body piece interfacing with thread channels on the interior of the second body piece and further wherein assembling the plug body to lock the contact combinations into place within the plug body at the predetermined angles further includes rotating the first body piece and the second body piece in relation to one another, causing the threads on the first body piece to engage with the thread channels on the second body piece, the rotation of the first body piece and the second body piece in relation to one another continuing until the first and second body pieces are snugly fit together, locking the contact combinations into place within the first body piece.

In one embodiment, the method for assembling and reconfiguring a reconfigurable power cord further includes determining a second configuration comprising a second predetermined angle for at least one of the contact combinations and then loosening the electrical plug so that the first and second body pieces are no longer snugly fit together. In one embodiment, the method proceeds with at least partially removing, from the first body piece, a particular contact combination having a second predetermined angle of the second configuration. In one embodiment, the first and second predetermined angles are the same. In one embodiment, the first and second predetermined angles are different from each other.

In one embodiment, the method proceeds with adjusting the angular position of the particular contact combination so that the adjusted contact combination is now at the second predetermined angle of the second configuration within the plug body so that the respective electrical contact is positioned within the associated plug cavity of the first body piece and aligned at respective second predetermined angle. Following the angular adjustment, the plug body is then reassembled to lock the contact combinations of the electrical plug into place within the plug body.

In one embodiment, the method for assembling and reconfiguring a reconfigurable power cord further includes wherein the electrical plug body comprises at least a first body piece having one or more body cavities for receiving the contact combinations and for securing each contact combination against rotation once a given contact combination is fully seated into its respective body cavity.

In one embodiment, a method for assembling and configuring a configurable electrical plug comprises inserting two or more electrical contacts into respective contact retainers, thereby forming two or more respective contact combinations, for each contact combination, inserting the contact combination within a first body piece of an electrical plug, the first body piece of the electrical plug having a plurality of cavities. In one embodiment, each cavity of the plurality of cavities is configured to receive a single contact combination, at least one of the plurality of cavities is configured to allow the contact combination to be positioned at one of a plurality of distinct angular positions, and the electrical contact combinations are removably and rotatably attached to the interior of the first body piece of the electrical plug.

In one embodiment the method proceeds with coupling a first faceplate to the first body piece of the electrical plug, the first faceplate having one or more apertures configured to enable one or more of the contact combinations to be locked in a first configuration in their respective cavities and angular positions. In one embodiment, the method proceeds with determining a second configuration comprising a second distinct position for at least one of the contact combinations and decoupling the first faceplate from the first body piece. In one embodiment the method further includes at least partially removing, from the first body piece, the at least one contact combination having a first distinct angular position within a first distinct cavity and re-positioning the at least one contact combination having the first distinct angular position within the first distinct cavity.

In one embodiment, re-positioning the at least one contact combination includes one or more of moving the at least one contact combination from a first distinct angular position in a first distinct cavity to a second distinct angular position in the first distinct cavity, moving the at least one contact combination from a first distinct angular position in a first distinct cavity to the first distinct angular position in a second distinct cavity, moving the at least one contact combination from a first distinct angular position in a first distinct cavity to a second distinct angular position in a second distinct cavity.

In one embodiment, the method proceeds with coupling a second faceplate to the first body piece of the electrical plug, the second faceplate having one or more apertures configured to allow one or more of the contact combinations to be locked into the second configuration in their respective cavities and angular positions. In one embodiment, when the second faceplate is coupled with the first body piece, the second faceplate is utilized to lock the two or more contact combinations into a second configuration, the second configuration being distinct from the first configuration.

In one embodiment, the method further includes, when the first faceplate is decoupled from the first body piece, re-positioning at least one electrical contact (when viewed end-on at a distal end of the electrical contact) within one of the plurality of cavities from a first distinct angular position to a second distinct angular position and further wherein, when a second faceplate is coupled with the first body piece, the second faceplate is utilized to lock one or more of the contact combinations into a second configuration, the second configuration being distinct from the first configuration.

In one embodiment, the method further includes, when the first faceplate is uncoupled from the first body piece, re-positioning at least one electrical contact (when viewed end-on at a distal end of the electrical contact) within one of the plurality of cavities up to 90 degrees along its longest axis from a first distinct angular position to a second distinct angular position and further wherein, when a second faceplate is coupled with the first body piece, the second faceplate may be utilized to lock one or more of the contact combinations into a second configuration, the second configuration being distinct from the first configuration.

In one embodiment, the method further includes, when the first faceplate is uncoupled from the first body piece, re-positioning at least one electrical contact (when viewed end-on at a distal end of the electrical contact) within one of the plurality of cavities 90 degrees along its longest axis from a first distinct angular position to a second distinct angular position and further wherein, when a second faceplate is coupled with the first body piece, the second faceplate may be utilized to lock one or more of the contact combinations into a second configuration, the second configuration being distinct from the first configuration.

In one embodiment, the method further includes, when the first faceplate is decoupled from the first body piece, re-positioning at least one electrical contact (when viewed end-on at a distal end of the electrical contact) with respect to the plug body, within one of the plurality of cavities at least 45 degrees along its longest axis from a first distinct angular position to a second distinct angular position and further wherein, when a second faceplate is coupled with the first body piece, the second faceplate is utilized to lock one or more of the contact combinations into a second configuration, the second configuration being distinct from the first configuration.

In one embodiment, the first faceplate that locks the contact combinations in the first configuration has apertures that are differently shaped, differently sized, and/or differently positioned than the apertures of the second faceplate that locks the contact combinations in the second configuration. In one embodiment, when the configurable electrical plug is fully assembled, a faceplate prevents each of the one or more contact combinations from pulling out of its respective cavity, and further secures each contact combination against rotation once a given contact combination is fully seated into its respective body cavity. In one embodiment, each electrical contact of a given contact combination configuration is secured within a contact retainer which itself is removably secured within one of the plurality of cavities of the first body piece, each contact retainer being prevented from rotation within the cavity when the contact retainer is locked in an operational position. In one embodiment, one or more of the contact combinations are at a first predetermined angular position with respect to a reference line and one or more of the contact combinations are at a second predetermined angular position with respect to the reference line, the first predetermined angular position being distinct from the second predetermined angular position.

In one embodiment, a configurable electrical plug assembly comprises one or more electrical contacts inserted into respective contact retainers, thereby forming one or more contact combinations, a first body piece of an electrical plug body having a plurality of cavities. In one embodiment, each cavity is configured to receive a single contact combination, at least one cavity configured to allow the respective contact combination to be positioned in one of a plurality of distinct cavities at one of a plurality of distinct angular positions, the respective contact combinations being removably and rotatably attached to the interior of the first body piece. In one embodiment, one or more faceplates couple with the first body piece, the faceplates having one or more apertures configured to allow one or more of the contact combinations to be locked into one of a plurality of distinct configurations.

Further embodiments will be obvious to persons of ordinary skill having the benefit of this disclosure.

Figure 1:
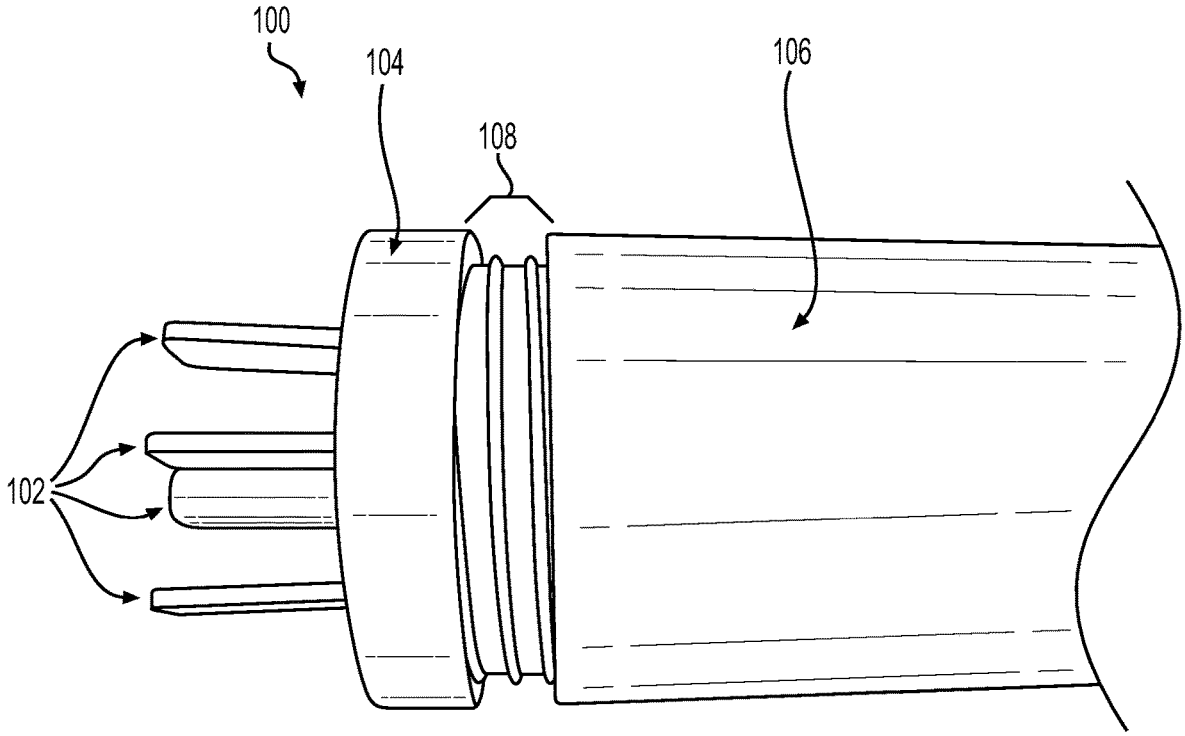
FIG. 1 is diagram of an electrical plug body, in accordance with one embodiment.

Common reference numerals are used throughout the figures and the detailed description to indicate like elements. One skilled in the art will readily recognize that the above figures are examples and that other architectures, modes of operation, orders of operation and elements/functions can be provided and implemented without departing from the characteristics and features of the invention, as set forth in the claims.

DETAILED DESCRIPTION

Embodiments will now be discussed with reference to the accompanying figures, which depict one or more exemplary embodiments. Embodiments may be implemented in many different forms and should not be construed as limited to the embodiments set forth herein, shown in the figures, and/or described below. Rather, these exemplary embodiments are provided to allow a complete disclosure that conveys the principles of the invention, as set forth in the claims, to those of skill in the art.

In this disclosure, the embodiments are exemplary, and individual features from one or more of the exemplary embodiments are contemplated to work together and may be combined into collections of features that may differ from the particular features of exemplary embodiments discussed herein. However, those combinations are well within the scope of the inventions discussed herein.

Embodiments herein include an electrical plug that has electrical contacts that can rotate to fit multiple configurations of female ends that are on the market today. Further, various pieces of the electrical plug are configured to accommodate various embodiments having different numbers of electrical contacts, such as two electrical contacts, three electrical contacts, or four electrical contacts, with up to seven different locations for the electrical contacts available in the first body piece, depending on a given design of an implementation of the features discussed herein. Further, the types of electrical contacts may also be varied. For example, some electrical contacts are long and flat, and are presented as a blade. Others, have an arcuate shape, L shape, a U shape, or other shape, depending on what the interfacing female socket or receptacle is configured for. Further, the possible angular orientations of the various numbers of electrical contacts are controllable by the design of a particular implementation of the claimed invention. Thus, several different embodiments having different possible angular orientations and different numbers of electrical contacts at the various different possible angular orientations may be accommodated in various designs according to the principles discussed herein.

In addition to being configured for electrical contact rotation, the electrical plug is also a modular system in order to accommodate spacing and prong style differences that rotation alone cannot achieve. In one embodiment, replacing a flat electrical contact with an L shape electrical contact is enabled by the modular characteristics discussed herein. The inventions discussed herein make switching configurations easy and quick, and are safe to reconfigure.

FIG. 1 is diagram of an electrical plug body, according to one embodiment.

Referring to FIG. 1, in various embodiments, electrical plug 100 includes one or more of electrical contacts 102, first body piece 104 and second body piece 106. First body piece 104 houses electrical contacts 102 as discussed herein, and includes outward-facing threads 108 on a surface of first body piece 104 that interface and couple with interior thread channels of second body piece 106.

In one embodiment, electrical contacts 102 are formed of a conductive rigid metal alloy that includes one or more metals and/or one or more nonmetals of appropriate conductivity and other characteristics well known to those of ordinary skill.

In one embodiment, first body piece 104 couples with second body piece 106 through threads 108 on the exterior of a portion the first body piece interfacing with thread channels (not shown) on the interior of second body piece 106. During assembly, when assembling the electrical plug body to lock electrical contacts 102 into place within electrical plug 100 at predetermined angles, the first body piece and the second body piece are rotated in relation to one another, causing threads 108 on first body piece 104 to engage with thread channels on second body piece 106, the rotation continuing until first body piece 104 and second body piece 106 are snugly fit together, putting pressure on contact combinations within the plug body and locking electrical contacts 102 into place within first body piece 104.

Figure 2:
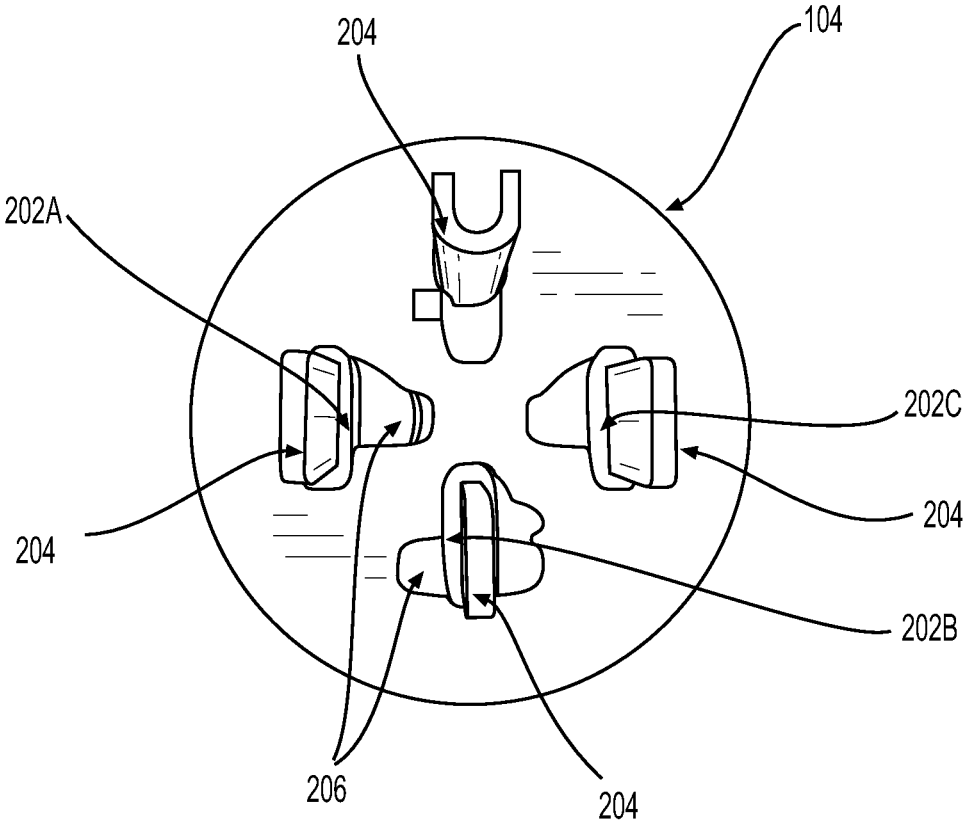
FIG. 2 is a top end front view of an assembled electrical plug, in accordance with one embodiment.

FIG. 2 is a top end front view of an assembled electrical plug, according to one embodiment.

Referring to FIG. 1 and FIG. 2 together, first body piece 104 of electrical plug 100 is shown end-on, with electrical contacts 102 originating from within first body piece 104, passing through and secured by respective contact combinations 202*a*, 202*b*, and 202*c*. The distal ends 204 of the electrical contacts are pointed at or towards the viewer. Although four contact combinations having four electrical contacts are shown, any number of contact combinations, or alternatively contact retainers and/or electrical contacts between two and six are contemplated. Therefore, in various embodiments, any number e.g. two, three, four, five, or six electrical contact/contact retainer pairs, e.g. contact combinations, are contemplated. In one embodiment, one or more cavities 206 of first body piece 104 don't have a respective contact combination installed therein, but instead are plugged and thus have at least a portion of a contact retainer, and optionally have at least a portion of an electrical contact installed therein to fill the cavity without utilizing the cavity to support a contact combination which extrudes from the electrical plug.

Each contact retainer, such as contact combinations 202*a*, 202*b*, and 202*c*, is shown with a raised contact retainer component discussed below which helps secure contact combinations in the cavities at desired angular configurations.

In one embodiment, a given cavity is keyed with a given contact retainer/contact combination so that only particular contact combinations are able to be inserted into the given cavity.

Figure 3A:
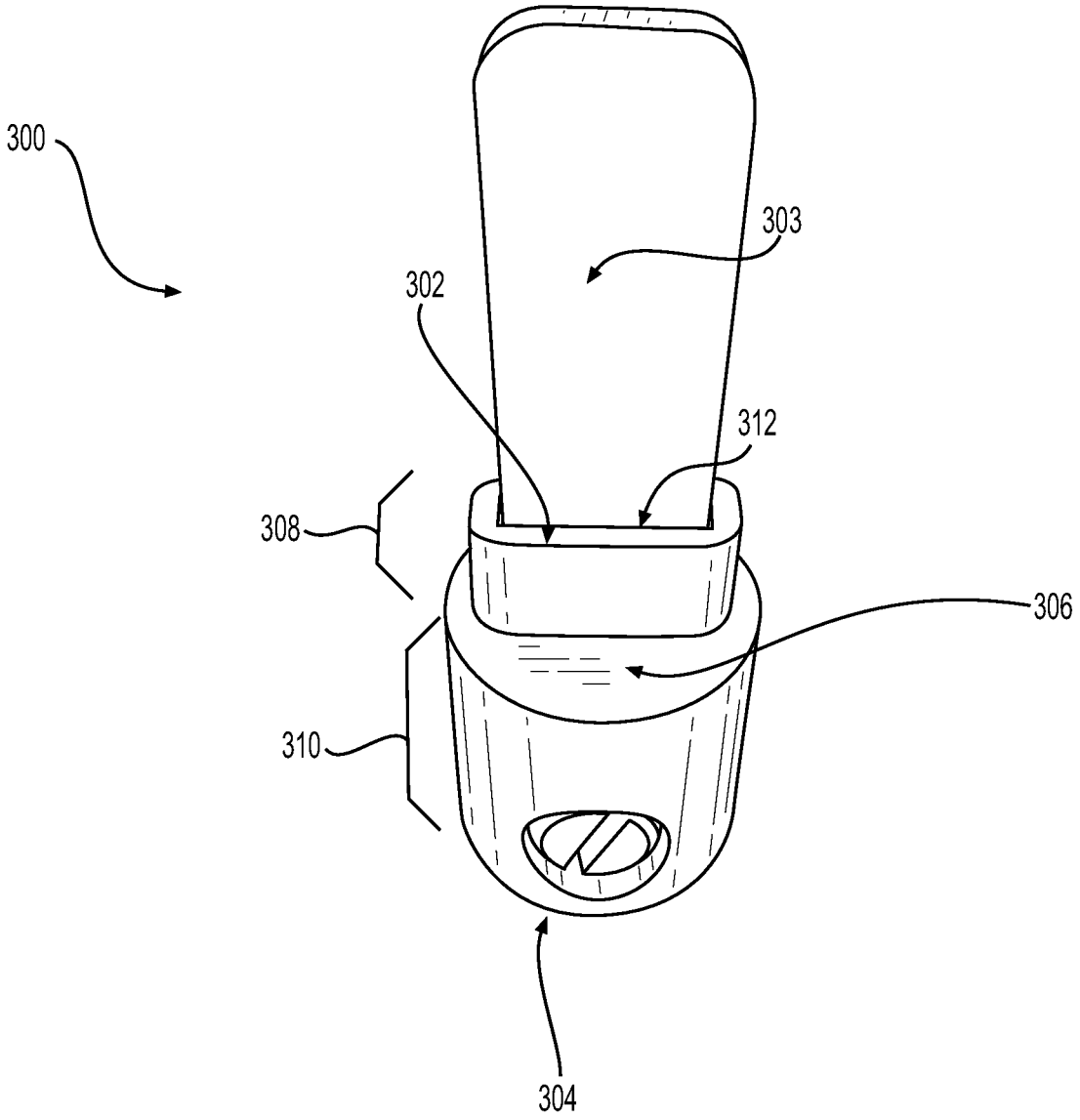
FIGS. 3A and 3B are together a depiction of a contact retainer, in accordance with one embodiment.
Figure 3B:
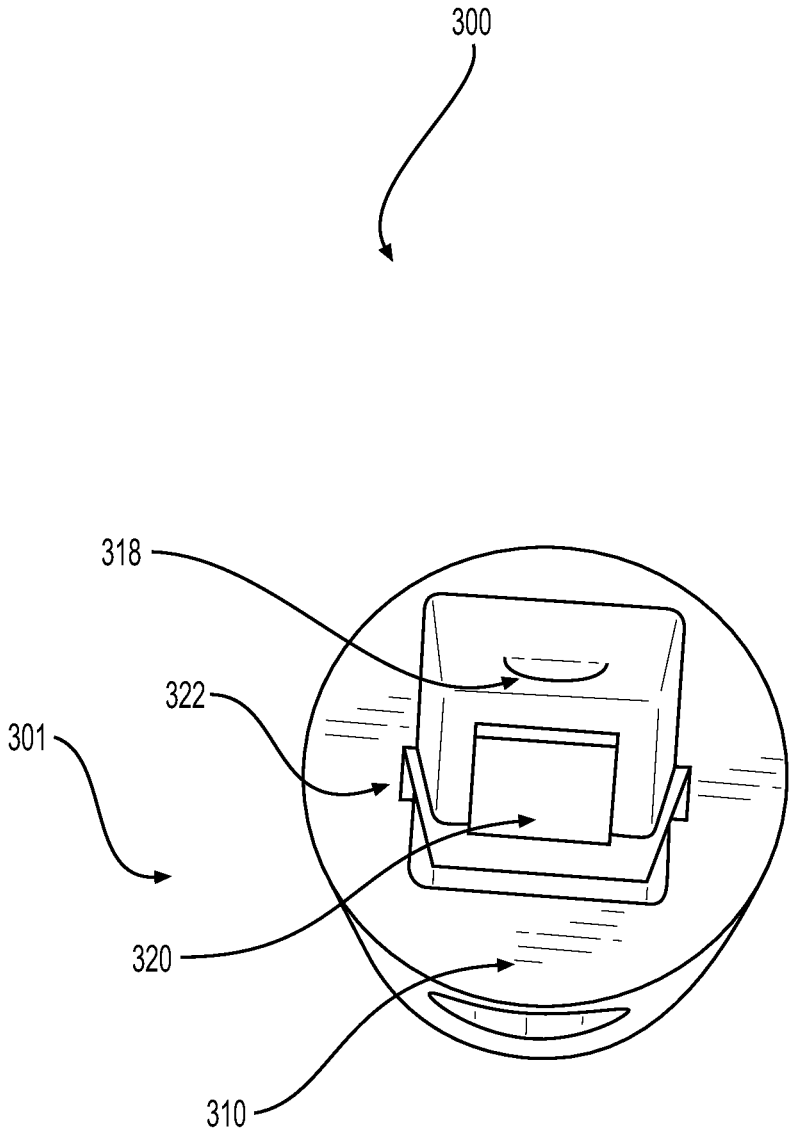

FIG. 3A is a depiction of a contact combination according to one embodiment. FIG. 3B is a depiction of the bottom side of a contact retainer of the contact combination of FIG. 3A, according to one embodiment.

Referring to FIG. 1, FIG. 2 and FIGS. 3A and 3B together, contact combination 300 is formed from a combination of contact retainer 301 and electrical contact 303 and has, in one embodiment, a top side 302 and a bottom side 304 (the flat side which is resting on the surface). Contact combination 300 further includes, in one embodiment, a stabilizing surface 306 for preventing the top area 308 of contact combinations 300 from entering into a cavity of first body piece 104 farther than desired, according to a particular design desired by an implementer of the inventive features described herein.

In one embodiment, a portion of bottom area 310 of contact combination 300 is hollowed out as a contact retainer cavity (see FIG. 3B) to allow an end of an electrical contact, such as electrical contact 303, to be accommodated therein.

Locking portion 318 of contact retainer 301 is a hollowed out area having a matching bump on electrical contact 303 to be permanently installed into contact retainer 301. When electrical contact 303 is pushed into slotted area 322 of contact retainer 301, a blade of electrical contact 303 (or other shape as discussed herein) passes through slotted area 322 which is slotted through so that the blade of electrical contact 303 passes through contact retainer 301 until a base of electrical contact 303 engages the contact retainer cavity. Because the base of the electrical contact largely fills the contact retainer cavity, the bump on electrical contact 303 temporarily deforms the cavity in the area of the bump, as the bump passes through the area towards the locking portion 318. As electrical contact reaches its final position within contact retainer 301, the bump on electrical contact 303 fits snugly into locking portion 318 of contact retainer 301.

Also provided as an optional feature of contact retainer 301 is an alignment point 320 which is an indented area of contact retainer 301 which serves to support electrical contact 303 as it is being seated within contact retainer 301.

To recap, when a base end of an electrical contact, such as an electrical contact 303, is attached to a conductor of a power cable, the distal end of the electrical contact first passes through bottom area 310 of contact retainer 301 and into a bottom end of slot 312 up through the top end 312 of the slot (see FIG. 3B).

Figure 4:
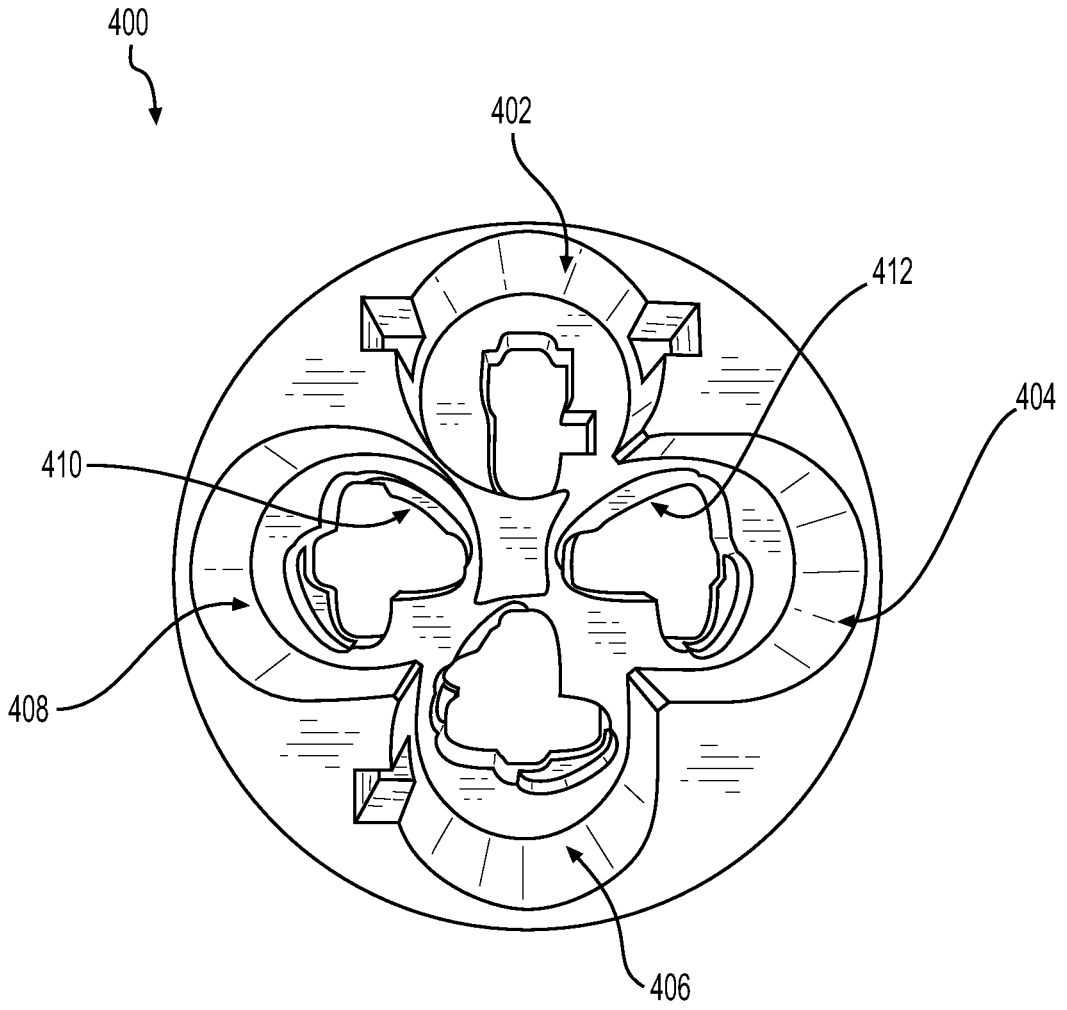
FIG. 4 is an interior view of a first body piece of an electrical plug, in accordance with one embodiment.

FIG. 4 is an interior view of a first body piece of an electrical plug according to one embodiment.

Referring to FIG. 1, FIG. 2, FIG. 3A, FIG. 3B, and FIG. 4 together, first body piece 400 is, in one embodiment, a single molded piece, or formed through 3D printing or some other suitable means known to those of ordinary skill. First body piece 400 includes one or more first body piece cavities, such as first body piece cavities 402, 404, 406 and 408, through which contact combinations, such as contact combinations 202*a*, 202*b*, and 202*c* pass into and are secured when outward-facing threads 108 on a surface of first body piece 104 that interface and couple with interior thread channels of second body piece 106 are mated together and secured through a rotation of first body piece 104 with respect to second body piece 106 until the two pieces fit snugly together. Top area 308 of contact retainer 301 has a thickness, a distance measured from top side 302 to stabilizing surface 306 which matches a thickness of a wall of cutout 410, for example, of cavity 408. Thus, when an electrical contact, such as electrical contact 303 is inserted into a contact retainer, such as contact retainer 301, for example, and the resulting contact combination is then subsequently fit into a first body piece cavity, such as first body piece cavity 402, of first body piece 104, contact combination 202*a* is positioned at the desired angle and then secured within first body piece cavity 402 by ensuring that top side 302 of first body piece cavity 402 is flush, or relatively flush with a similar top side surface of first body piece 104, as is best seen in FIG. 2.

Persons of ordinary skill having the benefit of this disclosure will readily recognize that whatever angles are desired that the electrical contacts be able to be secured in are governed by the receiving cavity for a given contact, and what angles the given cavity is designed to receive.

Of note, channel 412 of cavity 402 allows for rotation within the channel with partial disassembly of a completed electrical plug, with the amount of possible rotation being governed by the number of degrees of the corresponding area the channel is formed over. Here, the channel is depicted as being formed over 90 degrees, thus allowing rotation after partial disassembly of a given associated contact combination, of 90 degrees. Other degree measures of the channel are possible, and contemplated. For example, the channel can be formed around 45 degrees, 135 degrees, or any other degree measure, as desired by a designer of a particular implementation of the inventive features discussed herein.

Figure 5A:
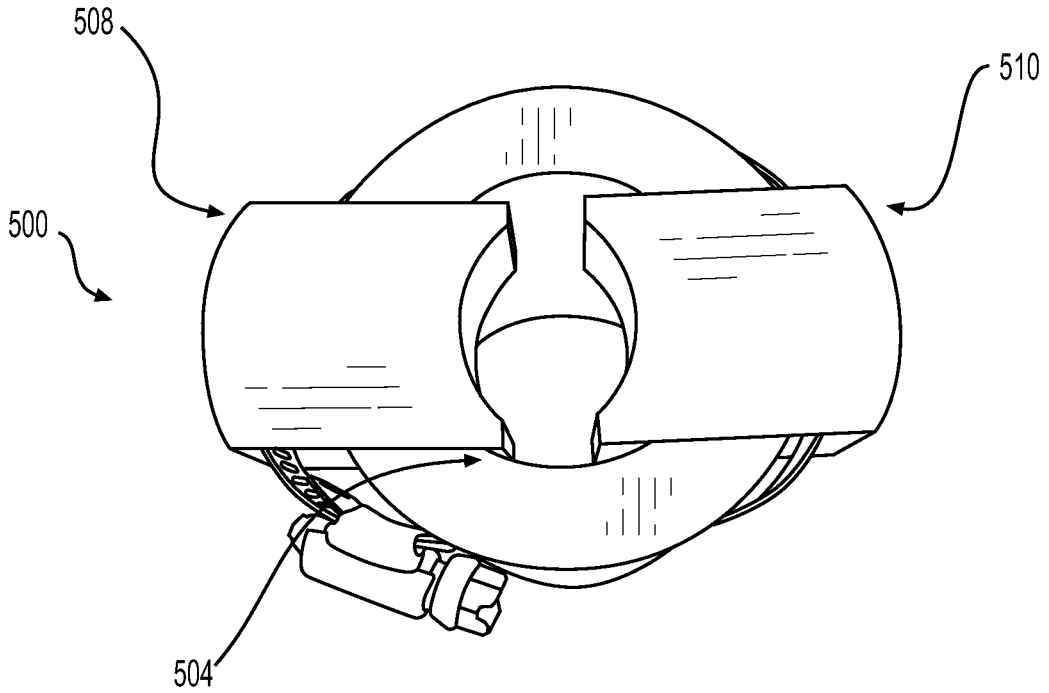
FIGS. 5A and 5B depict a rear portion of a second piece of an electrical plug body, in accordance with one embodiment.
Figure 5B:
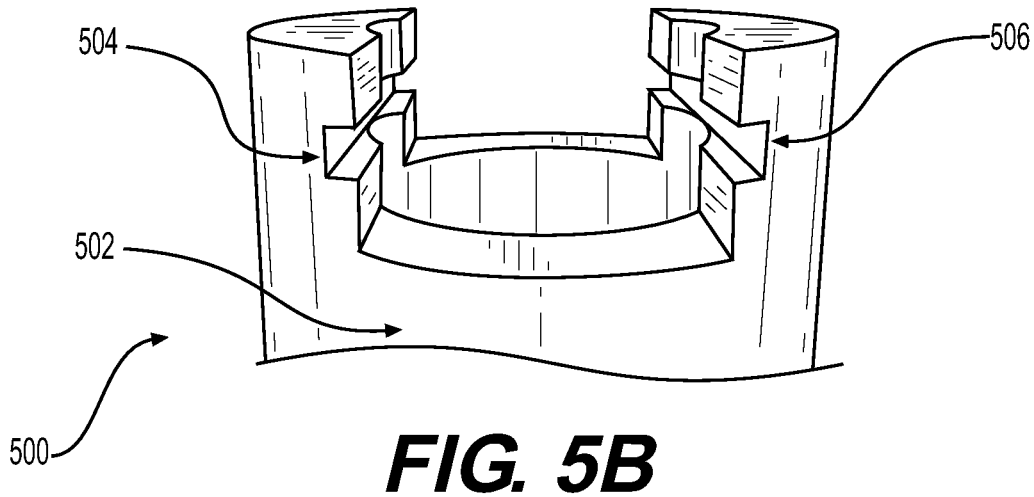

FIGS. 5A and 5B depict a rear portion of a second piece of an electrical plug body according to one embodiment.

Referring to FIGS. 5A and 5B, a second end 500 of second body piece 502 is presented, which is the opposite end of second body piece 106 of FIG. 1. At this end of electrical plug 100, a power cable attached to electrical contacts of electrical plug 100 will typically be seen, in a completely assembled power cable configuration. The power cable exits this second end 500 of second body piece 502, passing between two rails 504 and 506 which provide support to a clasping mechanism which secures the power cable rigidly within electrical plug 100. Channels within each of rails 504 and 506 allow slides 508 and 510 to slide back and forth between a clamped position securing the cable and a second nonclamped position allowing for reconfiguration of electrical plug 100. A hose clamp or other clamping mechanism positioned around the outside circumference of may serve to retain slides 508 and 510 in a clamped configuration, securing a power cable between them.

This cord lock design has several advantages over currently existing designs. Firstly, the cord lock design depicted herein it does not require screws. Screws can strip out and make the rest of the plug useless. Secondly, since the sliding pieces won't be able to fall off, it will help keep the entire device together when prongs are being changed. Lastly, a hose clamp used to tighten the sliders on the cord is quicker and easier than using screws.

Figure 6:
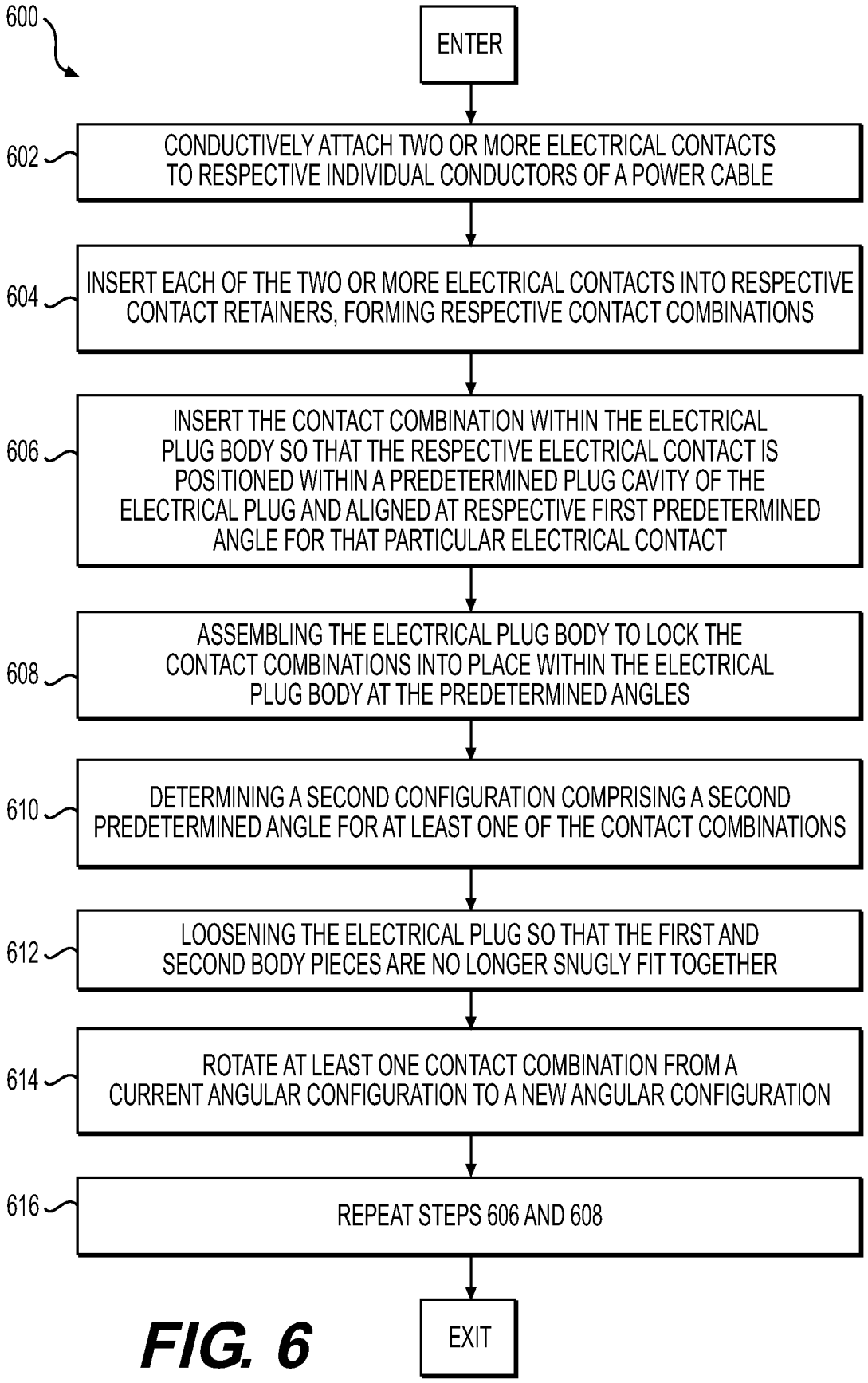
FIG. 6 is a flowchart of a process for assembling and reconfiguring an electrical plug, in accordance with one embodiment.

FIG. 6 is a flowchart depicting a process for assembling and reconfiguring an electrical plug according to one embodiment.

Referring to FIG. 6, process 600 begins at operation 602 when two or more electrical contacts are conductively attached to respective individual conductors of a power cable. By conductively attached, it is meant that the electrical contacts have continuity to the power cable, with little or no resistance measurable between the electrical contacts and the respective conductors of the power cable. Such connections may be achieved through crimping, clamping, soldering, and through other means known to those of ordinary skill.

At operation 604, the two or more electrical contacts are each inserted into respective contact retainers which are separate pieces that are normally installed within the electrical plug prior to operation, forming contact combinations.

At operation 606, each respective contact combination is inserted into individual electrical plug cavities so that the respective electrical contact is positioned at a respective individual predetermined angle. Each electrical contact may be positioned at a different angle, depending on the needs of a particular situation.

At operation 608, the body of the electrical plug is assembled, to lock the contact combinations into place within the electrical plug body at the predetermined angles. Using the embodiments of FIGS. 1 through 5, where the electrical plug includes at least a first body piece designed to secure the contact combinations at the predetermined angles, and a second body piece rotated so that threads on the first body piece screw on to channels of the second body piece. In one embodiment, the threads are on the second body piece and the channels are on the first body piece.

In one embodiment, assembly of the electrical plug includes securing the power cable to the plug. In one embodiment, a second end of second body piece is where the power cable exits the second body piece, passing between two rails which provide support to a clasping mechanism which secures the power cable rigidly within the electrical plug. A hose clamp or other clamping mechanism positioned around the outside circumference may serve to retain the slides in a clamped configuration, securing a power cable between them.

At operation 610, the process optionally includes a determination that one or more of the electrical contacts need to be rotated, to achieve a new configuration.

At operation 612, the electrical plug is partially disassembled, mostly to remove the pressure from the contact combinations so that one or more of those contact combinations can be rotated, at operation 614, to one or more new angles.

The electrical plug is then reassembled by performing one or more of operations 606 and 608 again at operation 616.

Figure 7A:
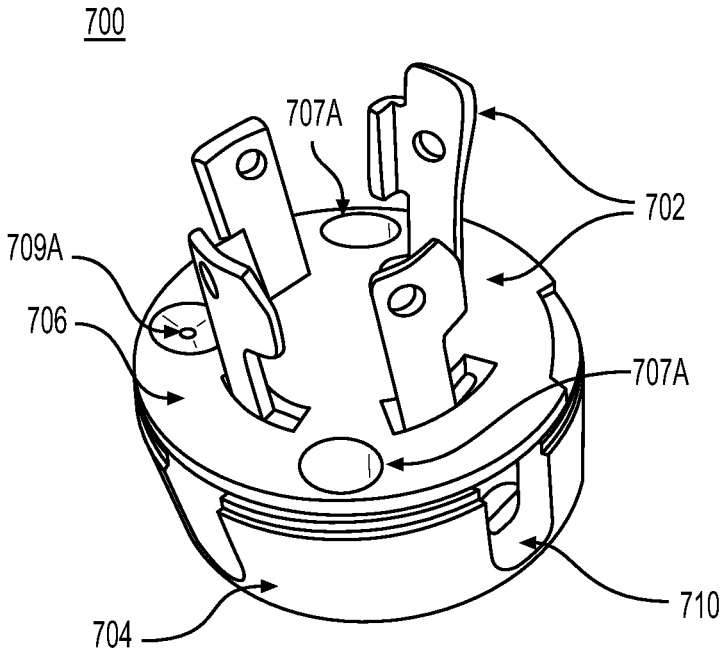
FIG. 7A depicts a partially assembled electrical plug with a faceplate to secure contact combinations positioned in a distinct configuration, in accordance with one embodiment.

FIG. 7A depicts a partially assembled electrical plug 700 with a faceplate to secure contact combinations positioned in a distinct configuration, in accordance with one embodiment.

Figure 7B:
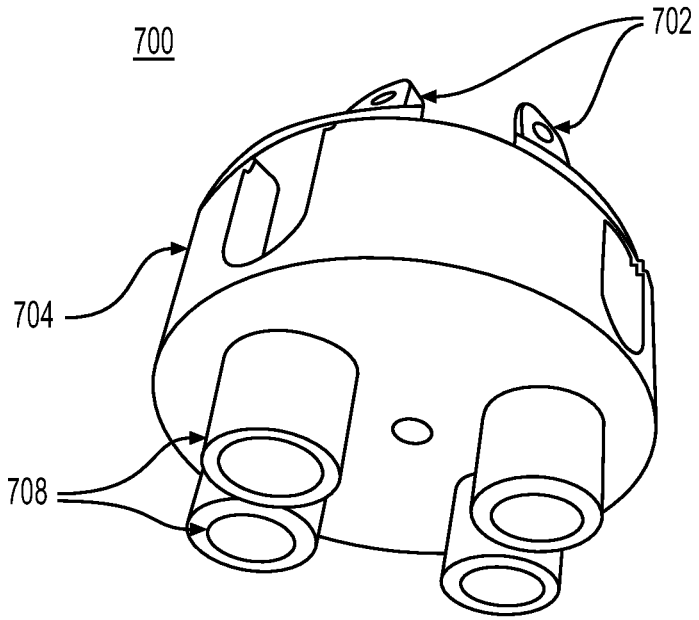
FIG. 7B depicts a rear view of a first electrical plug body piece, in accordance with one embodiment.

FIG. 7B depicts a rear view of a first electrical plug body piece of electrical plug 700, in accordance with one embodiment.

Figure 7C:
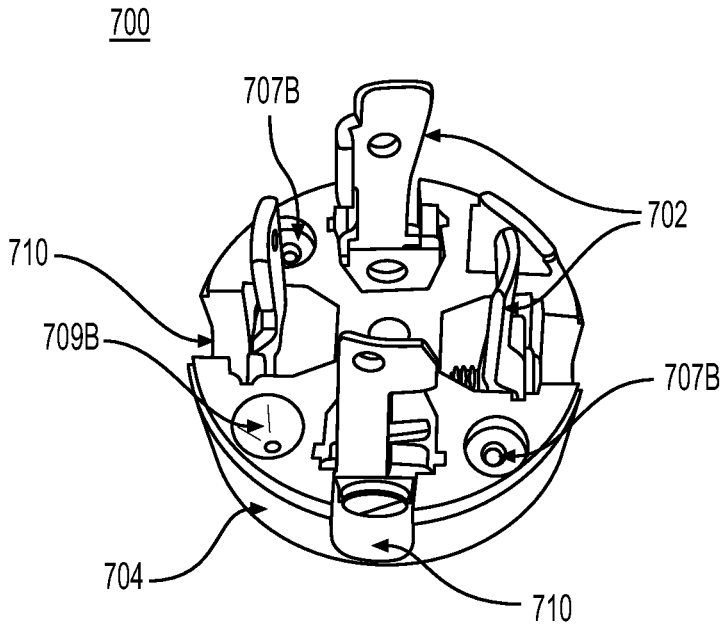
FIG. 7C depicts a first body piece of an electrical plug with contact combinations positioned in a distinct configuration and the faceplate removed, in accordance with one embodiment.

FIG. 7C depicts a first body piece of electrical plug 700 with contact combinations positioned in a distinct configuration and the faceplate removed, in accordance with one embodiment.

Figure 7D:
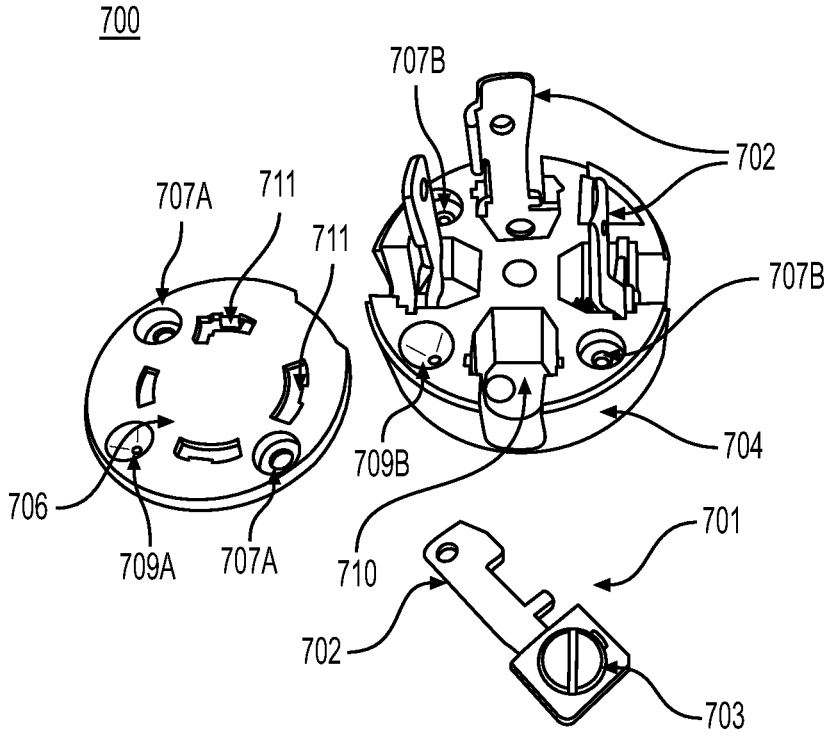
FIG. 7D depicts a partially disassembled electrical plug, in accordance with one embodiment.

FIG. 7D depicts a partially disassembled electrical plug 700, in accordance with one embodiment.

The embodiment of FIG. 7A through FIG. 7D together depict a configurable electrical plug that functions in largely the same manner as the electrical plug described in the above discussion of FIG. 1 through FIG. 6. In the embodiment of FIG. 7A through FIG. 7D, several modifications have been made to the assembly described above. For example, as shown in FIG. 7A, electrical plug 700 includes a first body piece 704, as well as a first faceplate 706, wherein the first faceplate 706 has one or more apertures 711 configured to allow contacts 702 to be locked into one or more distinct angular configurations. In one embodiment first faceplate 706 is able to be coupled to first body piece 704 through a coupling mechanism, such as, but not limited to, one or more screws. In one embodiment, faceplate 706 includes one-way screw slot 709*a* and one or more screw slots 707*a*, and first body piece 704 includes corresponding one-way screw slot 709*b* and corresponding one or more screw slots 707*b*, which will be discussed in additional detail below. As shown in FIG. 7B, in one embodiment, the first body piece 704 of electrical plug 700 includes a plurality of lower openings 708, which allow conductive wiring (not shown) to be conductively attached to the electrical contacts 702.

Referring to FIG. 1, FIG. 2, and FIG. 7A together, it should be noted that first faceplate 706, as shown in FIG. 7A, serves the same functional purpose as first body piece 104 of the embodiment shown in FIG. 1 and FIG. 2. That is, first faceplate 706 serves to lock the electrical contacts into place to ensure that the contact configuration doesn't change during use of electrical plug 700.

As discussed in detail above with respect to FIG. 2 through FIG. 4, one or more contacts are inserted into respective contact retainers. Referring to FIG. 7C and FIG. 7D together, in various embodiments, one or more contacts 702 are inserted into respective contact retainers, such as contact retainer 703, to form a plurality of contact combinations, such as contact combinations 701. In various embodiments, the first body piece 704 of electrical plug 700 includes a plurality of cavities 710, which, when the faceplate 706 is decoupled from the first body piece 704, allows one or more of the contact combinations 701 to be removed, rotated, and/or re-positioned within its respective cavity at one of a plurality of predetermined orientations and/or configurations.

In one embodiment, re-positioning the at least one electrical contact includes one or more of moving the at least one electrical contact from a first distinct angular position in a first distinct cavity to a second distinct angular position in the first distinct cavity, moving the at least one electrical contact from a first distinct angular position in a first distinct cavity to the first distinct angular position in a second distinct cavity, and moving the at least one electrical contact from a first distinct angular position in a first distinct cavity to a second distinct angular position in a second distinct cavity.

As shown in FIG. 7C and FIG. 7D, the contact combinations 701 may be inserted into a respective cavity 710 from the front of first body piece 704 (e.g. where the contact retainer 703 of contact combination 701 is inserted first into a cavity 710 of first body piece 704). This is in contrast to the design of FIG. 2 and FIG. 4, in which the distal ends 204 of contact combinations, such as contact combinations 202A, 202B, and 202C are inserted into respective ones of cavities 206 of first body piece 104 from the rear of first body piece 104 (which is shown as item 400 in FIG. 4).

Referring back to FIG. 7C and FIG. 7D, in one embodiment, first faceplate 706 may be recoupled to first body piece 704, or a second faceplate (not shown) may be coupled to first body piece 104 after re-positioning of one or more of the contact combinations 701. Coupling a faceplate to first body piece 104 prevents movement of the contact combinations 701 within their respective cavities 710. In one embodiment, first faceplate 706 or and/or a second faceplate may later be decoupled to arrange a new configuration of contact combinations 701. In one embodiment, once a configuration is determined for the contact combinations 701, the first faceplate 706 or a second faceplate may be permanently affixed to first body piece 704, such that the contact combinations can no longer be moved, rotated and/or reconfigured. In one embodiment, first faceplate 706 locks the contact combinations in a first configuration, and has apertures 711 that are differently shaped, differently sized, and/or differently positioned than the apertures on the second faceplate, which locks the contact combinations in a second configuration.

In one embodiment, one-way screw slot 709*a* of faceplate 706 and corresponding one-way screw slot 709*b* of first body piece 704 allow for the first faceplate 706 to be coupled to first body piece 704. In one embodiment, screw slots 707*a* of faceplate 706 and corresponding screw slots 707*b* of first body piece 704 allow for one or more contact combinations 701 to be secured to first body piece 704 of electrical plug 700, and also allow faceplate 706 to be secured to first body piece 704 of electrical plug 700. Screw slots 707*a* and 707*b* function to secure the one or more contact combinations 701 to first body piece 704 of electrical plug 700 in order to protect conductively attached wires (not shown). In one embodiment, the screws that secure the one or more contact combinations 701 to first body piece 704 also help to secure faceplate 706. It should be noted here that the above described coupling mechanisms are given for illustrative purposes only and are not intended to limit the scope of the invention as disclosed herein, and as claimed below.

Figure 7E:
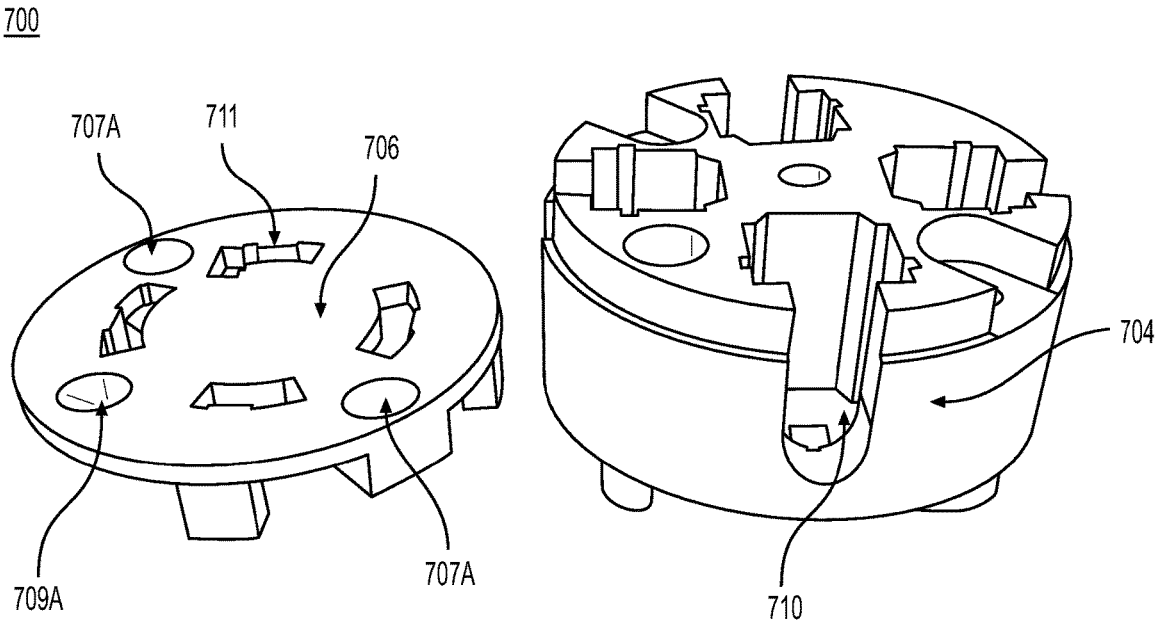
FIG. 7E through FIG. 7G depict alternate views of a first body piece and a faceplate of an electrical plug, in accordance with various embodiments.
Figure 7F:
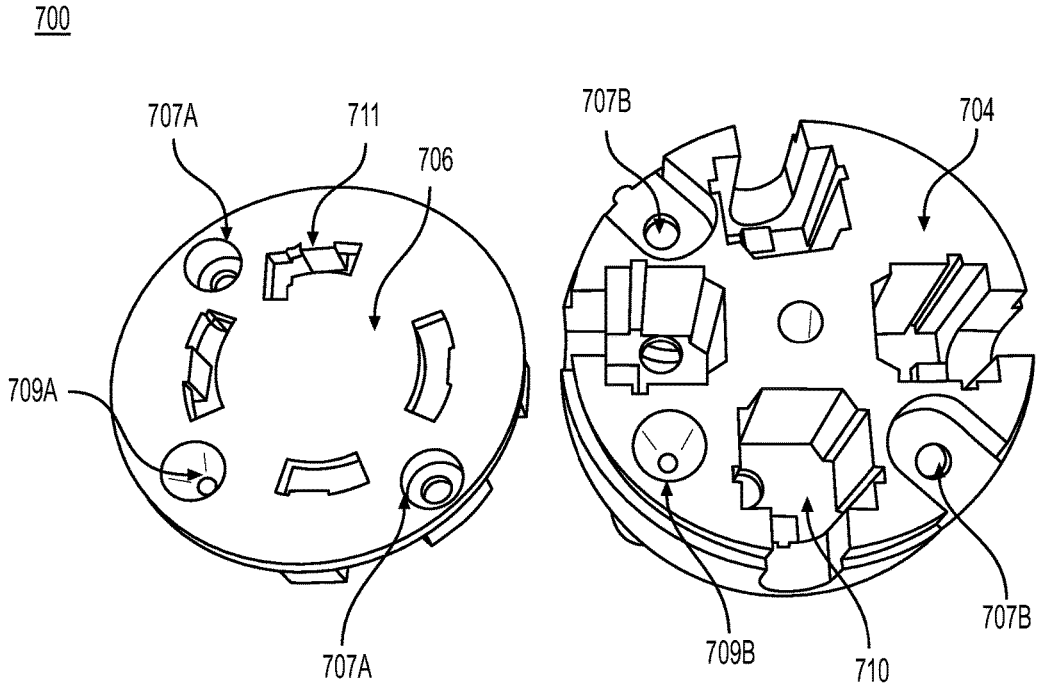
Figure 7G:
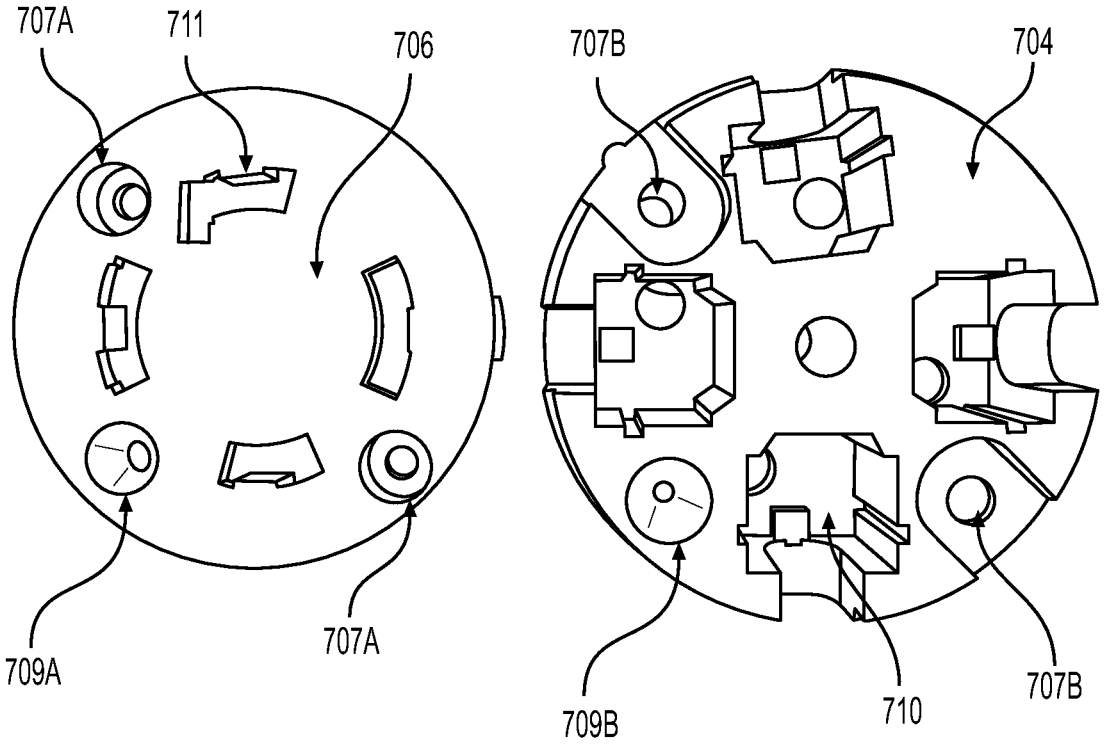

FIG. 7E through 7G depict alternate views of a first body piece 704 and faceplate 706 of an electrical plug 700, in accordance with various embodiments. As seen in FIG. 7E through FIG. 7G, faceplate 706 further includes one-way screw slot 709, screw slots 707, and apertures 711, and first body piece 104 further includes cavities 710, as discussed in greater detail above.

Figure 8:
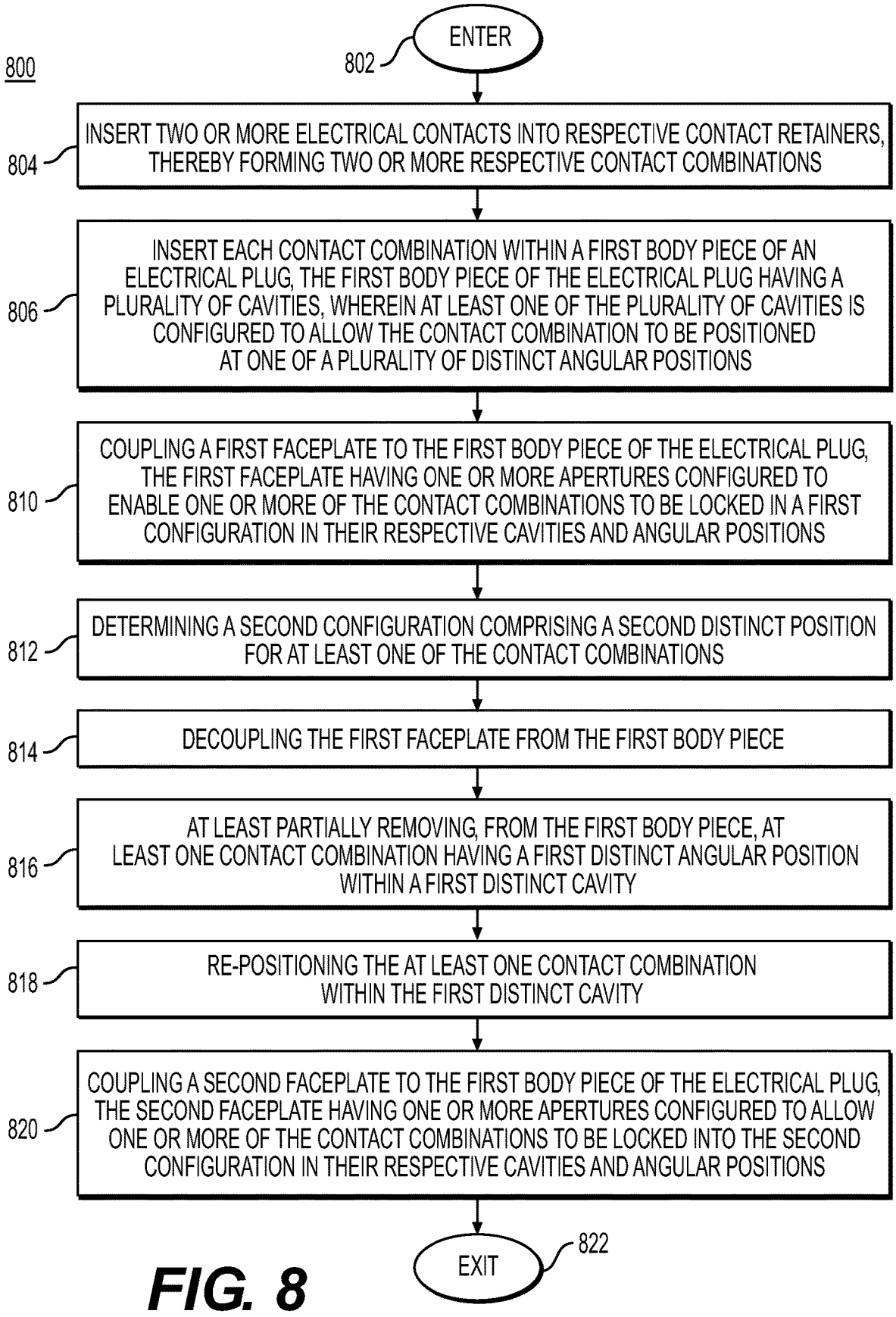
FIG. 8 is a flowchart of a process for assembling and configuring an electrical plug, in accordance with one embodiment.

FIG. 8 is a flowchart of a process for assembling and configuring an electrical plug, in accordance with one embodiment.

Referring to FIG. 8, process 800 begins at ENTER 802, and process flow proceeds to 804. In one embodiment, at 804, two or more electrical contacts are inserted into respective contact retainers which are separate pieces that are normally installed within the electrical plug prior to operation, forming two or more respective contact combinations.

In one embodiment, once two or more respective contact combinations are formed at 804, process flow proceeds to 806. In one embodiment, at 806, each respective contact combination is inserted within a first body piece of an electrical plug, wherein the first body piece of the electrical plug has a plurality of cavities. In one embodiment, each respective contact combination is inserted into the electrical plug cavities so that the respective electrical contact is positioned at one of a plurality of distinct angular positions. Each electrical contact combination may be positioned at a different angle, depending on the needs of a particular situation.

In one embodiment, once each contact combination is inserted into an electrical cavity at 806, process flow proceeds to 810. In one embodiment, at 810, a first faceplate is coupled to the first body piece of the electrical plug, to lock the contact combinations in a first configuration within cavities of the electrical plug body at their respective positions and angles. Using the embodiments of FIGS. 7A through 7D, the electrical plug includes at least two or more contact combinations, a first body piece, and one or more faceplates designed to secure the contact combinations at predetermined positions and angles within their respective cavities, such that they cannot be moved, repositioned and/or rotated when the electrical plug is in operation. In various embodiments, a user may select from multiple faceplates, each allowing for a distinct configuration of the two or more contact combinations to be secured and/or locked in place.

In one embodiment, once the first faceplate is coupled to the first body piece of the electrical plug at 810, process flow proceeds to 812. In one embodiment, at 812, the process optionally includes a determination that one or more of the electrical contacts needs to be rotated and/or repositioned, to achieve a new, second configuration.

In one embodiment, upon determination of a desired second configuration at 812, process flow proceeds to 814. In one embodiment, at 814, the electrical plug is partially disassembled, to decouple the first faceplate from the first body piece of the electrical plug such that one or more of the contact combinations can be rotated to one or more new angles, or moved to one or more new positions.

In one embodiment, once the first faceplate is decoupled from the first body piece at 814, process flow proceeds to 816. In one embodiment, at 816, at least one contact combination having a first distinct angular position within a first distinct cavity is at least partially removed from its respective cavity in the first body piece of the electrical plug.

In one embodiment, once the at least one contact combination is at least partially removed from its respective cavity at 816, process flow proceeds to 818. In one embodiment, at 818, the at least one contact combination is re-positioned within the first distinct cavity.

In one embodiment, re-positioning the contact combination includes one or more of moving the at least one contact combination from a first distinct angular position in a first distinct cavity to a second distinct angular position in the first distinct cavity, moving the at least one contact combination from a first distinct angular position in a first distinct cavity to the first distinct angular position in a second distinct cavity, moving the at least one contact combination from a first distinct angular position in a first distinct cavity to a second distinct angular position in a second distinct cavity.

In one embodiment, once the at least one contact combination is re-inserted within the first body piece at 818, process flow proceeds to 820. In one embodiment, at 820, the electrical plug is then reassembled by coupling a second faceplate to the first body piece of the electrical plug, the second faceplate having one or more apertures configured to allow one or more of the contact combinations to be locked into the second configuration in their respective cavities and angular positions. In one embodiment, the first faceplate that locks the contact combinations in the first configuration has apertures that are differently shaped, differently sized, and/or differently positioned than the apertures on the second faceplate that locks the contact combinations in the second configuration. In various embodiments, operations 812 through 820 may be repeated as many times as desired. In one embodiment, once a desired configuration has been achieved, the faceplate may be permanently coupled to the first body piece of the electrical plug to prevent further reconfiguration.

In one embodiment, once the second faceplate is coupled to the first body piece at 820, process flow proceeds to EXIT 822 and the process 800 for assembling and configuring an electrical plug is exited.

In the discussion above, certain aspects of one embodiment include a component of manufacture, process steps and/or operations and/or instructions described herein for illustrative purposes. However, the particular order and/or grouping shown and discussed herein are illustrative only and not limiting. Those of skill in the art will recognize that other orders and/or groupings are possible and, in some embodiments, one or more of the process steps and/or operations and/or instructions discussed above can be combined and/or deleted. In addition, portions of one or more of the process steps and/or operations and/or instructions can be re-grouped as portions of one or more other of the process steps and/or operations and/or instructions discussed herein. Consequently, the particular order and/or grouping of the process steps and/or operations and/or instructions discussed herein do not limit the scope of the invention as claimed below.

As discussed in more detail above, using the above embodiments, with little or no modification and/or input, there is considerable flexibility, adaptability, and opportunity for customization to meet the specific needs of various parties under numerous circumstances.

The present invention has been described in particular detail with respect to specific possible embodiments. Those of skill in the art will appreciate that the invention may be practiced in other embodiments. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

It should also be noted that the language used in the specification has been principally selected for readability, clarity and instructional purposes, and may not have been selected to delineate or circumscribe the inventive subject matter. Accordingly, the disclosure of the present invention is intended to be illustrative, but not limiting, of the scope of the invention, which is set forth in the claims below.

In addition, the operations shown in the figures, or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A configurable electrical plug assembly comprising:

power cord having a plurality of conductors, each individual conductor having a respective electrical contact conductively attached thereto;

a plug body;

a first body piece having a plurality of cavities, each cavity for receiving a single electrical contact, at least one cavity configured to allow the respective electrical contact to be positioned at one of a plurality of distinct angular positions, each electrical contact being supported within its cavity by a contact retainer that mounts within the first body piece to secure respective electrical contacts within the first body piece in a predetermined orientation, the respective contact retainers being removably and rotatably attached to the interior of the first body piece; and a first faceplate that couples with the first body piece, the first faceplate having one or more apertures configured to allow one or more of the electrical contacts to be locked in a first configuration at their respective predetermined cavities and angular orientations.

2. The configurable electrical plug of claim 1 wherein the first body piece and the first faceplate are configured such that the first faceplate can be decoupled from the first body piece to allow at least one electrical contact to be re-positioned, wherein re-positioning the at least one electrical contact includes one or more of:

moving the at least one electrical contact from a first distinct angular position in a first distinct cavity to a second distinct angular position in the first distinct cavity;

moving the at least one electrical contact from a first distinct angular position in a first distinct cavity to the first distinct angular position in a second distinct cavity; and moving the at least one electrical contact from a first distinct angular position in a first distinct cavity to a second distinct angular position in a second distinct cavity; and further wherein when a second faceplate is coupled with the first body piece, the second faceplate is utilized to lock the plurality of electrical contacts into a second configuration, the second configuration being distinct from the first configuration.

3. The configurable electrical plug of claim 1 wherein the first body piece and the first faceplate are configured such that the first faceplate can be decoupled from the first body piece to allow at least one electrical contact, when viewed end-on at a distal end of the electrical contact, to be re-positioned within one of the plurality of cavities from a first distinct angular position to a second distinct angular position, wherein when a second faceplate is coupled with the first body piece, the second faceplate is utilized to lock the plurality of electrical contacts into a second configuration, the second configuration being distinct from the first configuration.

4. The configurable electrical plug of claim 1 wherein the first body piece and the first faceplate are configured such that the first faceplate can be decoupled from the first body piece to allow at least one electrical contact, when viewed end-on at a distal end of the electrical contact, to be re-positioned within one of the plurality of cavities up to 90 degrees along its longest axis from a first distinct angular position to a second distinct angular position, wherein when a second faceplate is coupled with the first body piece, the second faceplate is utilized to lock the plurality of electrical contacts into a second configuration, the second configuration being distinct from the first configuration.

5. The configurable electrical plug of claim 1 wherein the first body piece and the first faceplate are configured such that the first faceplate can be decoupled from the first body piece to allow at least one electrical contact, when viewed end-on at a distal end of the electrical contact, to be re-positioned within one of the plurality of cavities 90 degrees along its longest axis from a first distinct angular position to a second distinct angular position, wherein when a second faceplate is coupled with the first body piece, the second faceplate is utilized to lock the plurality of electrical contacts into a second configuration, the second configuration being distinct from the first configuration.

6. The configurable electrical plug of claim 1 wherein the first body piece and the first faceplate are configured such that the first faceplate can be decoupled from the first body piece to allow at least one electrical contact, when viewed end-on at a distal end of the electrical contact with respect to the plug body, to be re-positioned within one of the plurality of cavities at least 45 degrees along its longest axis from a first distinct angular position to a second distinct angular position, wherein when a second faceplate is coupled with the first body piece, the second faceplate is utilized to lock the plurality of electrical contacts into a second configuration, the second configuration being distinct from the first configuration.

7. The configurable electrical plug of claim 1 wherein the first body piece, the first faceplate, and the second faceplate are configured to allow a fixed number of electrical contacts to be positioned within one of a number of cavities at one of a plurality of distinct angular positions.

8. The configurable electrical plug of claim 1 wherein the first faceplate that locks the contacts in the first configuration has apertures that are one or more of differently shaped, differently sized, and differently positioned than the apertures of the second faceplate that locks the contacts in the second configuration.

9. The configurable electrical plug of claim 1 wherein when the electrical plug is fully assembled into a given configuration, a faceplate secures the contacts to prevent movement of the contact retainers and the electrical contacts with respect to the plug body.

10. The configurable electrical plug of claim 1 wherein in a given configuration, each electrical contact of the given configuration is secured within a contact retainer which itself is removably secured within a cavity of the first body piece, the contact retainer being prevented from rotation within the cavity when the contact retainer is locked in an operational position.

11. A method for assembling and configuring a configurable electrical plug comprising:

inserting two or more electrical contacts into respective contact retainers, thereby forming two or more respective contact combinations;

for each contact combination, inserting the contact combination within a first body piece of an electrical plug, the first body piece of the electrical plug having a plurality of cavities, wherein:

each cavity of the plurality of cavities is configured to receive a single contact combination;

at least one of the plurality of cavities is configured to allow the contact combination to be positioned at one of a plurality of distinct angular positions; and the electrical contact combinations are removably and rotatably attached to the interior of the first body piece of the electrical plug;

coupling a first faceplate to the first body piece of the electrical plug, the first faceplate having one or more apertures configured to enable one or more of the contact combinations to be locked in a first configuration in their respective cavities and angular positions;

determining a second configuration comprising a second distinct position for at least one of the contact combinations;

decoupling the first faceplate from the first body piece;

at least partially removing, from the first body piece, at least one contact combination having a first distinct angular position within a first distinct cavity;

re-positioning the at least one contact combination having the first distinct angular position within the first distinct cavity; and coupling a second faceplate to the first body piece of the electrical plug, the second faceplate having one or more apertures configured to allow one or more of the contact combinations to be locked into the second configuration in their respective cavities and angular positions.

12. The method of claim 11 wherein re-positioning the at least one contact combination includes one or more of:

moving the at least one contact combination from a first distinct angular position in a first distinct cavity to a second distinct angular position in the first distinct cavity;

moving the at least one contact combination from a first distinct angular position in a first distinct cavity to the first distinct angular position in a second distinct cavity; and moving the at least one contact combination from a first distinct angular position in a first distinct cavity to a second distinct angular position in a second distinct cavity; and further wherein when a second faceplate is coupled with the first body piece, the second faceplate is utilized to lock one or more of the contact combinations into a second configuration, the second configuration being distinct from the first configuration.

13. The method of claim 11 wherein, when the first faceplate is decoupled from the first body piece, at least one electrical contact, when viewed end-on at a distal end of the electrical contact, is re-positioned within one of the plurality of cavities from a first distinct angular position to a second distinct angular position and further wherein, when a second faceplate is coupled with the first body piece, the second faceplate is utilized to lock one or more of the contact combinations into a second configuration, the second configuration being distinct from the first configuration.

14. The method of claim 11 wherein when the first faceplate is uncoupled from the first body piece, at least one electrical contact, when viewed end-on at a distal end of the electrical contact, is re-positioned within one of the plurality of cavities up to 90 degrees along its longest axis from a first distinct angular position to a second distinct angular position and further wherein, when a second faceplate is coupled with the first body piece, the second faceplate may be utilized to lock one or more of the contact combinations into a second configuration, the second configuration being distinct from the first configuration.

15. The method of claim 11 wherein, when the first faceplate is uncoupled from the first body piece, at least one electrical contact, when viewed end-on at a distal end of the electrical contact, is re-positioned within one of the plurality of cavities 90 degrees along its longest axis from a first distinct angular position to a second distinct angular position and further wherein, when a second faceplate is coupled with the first body piece, the second faceplate may be utilized to lock one or more of the contact combinations into a second configuration, the second configuration being distinct from the first configuration.

16. The method of claim 11 wherein, when the first faceplate is decoupled from the first body piece, at least one electrical contact, when viewed end-on at a distal end of the electrical contact with respect to the plug body, is re-positioned within one of the plurality of cavities at least 45 degrees along its longest axis from a first distinct angular position to a second distinct angular position and further wherein, when a second faceplate is coupled with the first body piece, the second faceplate is utilized to lock one or more of the contact combinations into a second configuration, the second configuration being distinct from the first configuration.

17. The method of claim 11 wherein the first faceplate that locks the contact combinations in the first configuration has apertures that are one or more of differently shaped, differently sized, and differently positioned than the apertures of the second faceplate that locks the contact combinations in the second configuration.

18. The method of claim 11 wherein, when the configurable electrical plug is fully assembled, a faceplate prevents each of the one or more contact combinations from pulling out of its respective cavity, and further secures each contact combination against rotation once a given contact combination is fully seated into its respective body cavity.

19. The method of claim 11 wherein each electrical contact of a given contact combination configuration is secured within a contact retainer which itself is removably secured within one of the plurality of cavities of the first body piece, each contact retainer being prevented from rotation within the cavity when the contact retainer is locked in an operational position.

20. A configurable electrical plug assembly comprising:

one or more electrical contacts inserted into respective contact retainers, thereby forming one or more contact combinations;

a first body piece of an electrical plug body having a plurality of cavities, each cavity configured to receive a single contact combination, at least one cavity configured to allow the respective contact combination to be positioned in one of a plurality of cavities at one of a plurality of angular positions, the respective contact combinations being removably and rotatably attached to the interior of the first body piece; and one or more faceplates that couple with the first body piece, the faceplates having one or more apertures configured to allow one or more of the contact combinations to be locked into one of a plurality of distinct configurations.

* * * * *